US008752250B2

(12) United States Patent
Wedegaertner et al.

(10) Patent No.: US 8,752,250 B2
(45) Date of Patent: Jun. 17, 2014

(54) COTTONSEED DELINTERS AND METHODS

(71) Applicants: Thomas C. Wedegaertner, Cary, NC (US); Gregory A. Holt, Lubbock, TX (US)

(72) Inventors: Thomas C. Wedegaertner, Cary, NC (US); Gregory A. Holt, Lubbock, TX (US)

( * ) Notice: Subject to any disclaimer, the term of this patent is extended or adjusted under 35 U.S.C. 154(b) by 0 days.

(21) Appl. No.: 13/673,743

(22) Filed: Nov. 9, 2012

(65) Prior Publication Data

US 2013/0067690 A1 Mar. 21, 2013

Related U.S. Application Data

(63) Continuation-in-part of application No. 13/117,697, filed on May 27, 2011, now Pat. No. 8,336,170.

(51) Int. Cl.
*D01B 1/04* (2006.01)

(52) U.S. Cl.
USPC ..... 19/41

(58) Field of Classification Search
USPC ..... 19/40, 41; 99/626, 627, 630; 426/483
See application file for complete search history.

(56) References Cited

U.S. PATENT DOCUMENTS

| | | | |
|---|---|---|---|
| 384,340 | A | 6/1888 | Weatherhead et al. |
| 557,789 | A | 4/1896 | Faulkner |
| 691,272 | A | 1/1902 | Kasmeier |
| 986,415 | A | 3/1911 | White |
| 1,038,927 | A | 9/1912 | McCormick |
| 1,353,295 | A | 9/1920 | Voorhies |
| 1,449,847 | A | 3/1923 | Voorhies |
| 1,457,329 | A | 6/1923 | Voorhies |
| 2,064,602 | A | 12/1936 | Harris |
| 2,191,893 | A | 2/1940 | McDonald et al. |
| 2,433,178 | A | 12/1947 | Ware |
| 2,724,148 | A | 11/1955 | McMath |
| 3,402,076 | A | 9/1968 | Johnson |
| 3,484,904 | A | 12/1969 | Berriman et al. |
| 3,805,332 | A | 4/1974 | Williams et al. |
| 3,943,604 | A | 3/1976 | Harrington et al. |
| 4,028,852 | A | 6/1977 | Harrington et al. |
| 4,154,021 | A | 5/1979 | Griffith et al. |
| 4,441,232 | A | 4/1984 | Underbrink et al. |
| 4,520,529 | A | 6/1985 | Davis |
| 4,942,643 | A | 7/1990 | Kincer et al. |
| 4,967,448 | A | 11/1990 | Mizer |
| 5,245,919 | A | 9/1993 | Neidigh |

(Continued)

FOREIGN PATENT DOCUMENTS

GB 1061462 A 3/1967

OTHER PUBLICATIONS

International Search Report and Written Opinion date mailed Jul. 23, 2012; PCT International Application No. PCT/US2012/038047.

*Primary Examiner* — Shaun R Hurley
(74) *Attorney, Agent, or Firm* — R. Johnston Law, PLLC

(57) ABSTRACT

Systems and methods for removing material, e.g., linters, from seeds, e.g., ginned cottonseeds, are provided. The systems and methods involve rotating the seeds in a rotatable drum having a plurality of longitudinal brushes. The centrifugal force created by the rotation of the drum and the plurality of longitudinal brushes urge the seeds against an interior surface of the drum that is lined with a brush insert. In this way, work is performed that removes the material from the exterior of the seeds. The material is removed using reduced pressure and the processed seeds are removed. The system may include a brush insert that is easily removed from the rotatable drum. Other systems and methods are disclosed.

20 Claims, 11 Drawing Sheets

FIG. 5

(56) References Cited

U.S. PATENT DOCUMENTS

| | | | | |
|---|---|---|---|---|
| 5,249,335 | A | 10/1993 | Jones | |
| 5,423,107 | A | 6/1995 | Thrash | |
| 6,776,087 | B1 | 8/2004 | Amstad | |
| 7,428,863 | B2 | 9/2008 | Wallace | |
| 8,336,170 | B2 * | 12/2012 | Wedegaertner | 19/41 |
| 2005/0082144 | A1 | 4/2005 | Maupin et al. | |
| 2005/0217076 | A1 | 10/2005 | Gvili et al. | |
| 2012/0297579 | A1 * | 11/2012 | Wedegaertner | 19/41 |
| 2013/0067690 | A1 * | 3/2013 | Wedegaertner et al. | 19/41 |

* cited by examiner

COTTONSEED DELINTERS AND METHODS

RELATED APPLICATIONS

The present application is a continuation-in-part of U.S. patent application Ser. No. 13/117,697, filed on May 27, 2011, entitled "Cottonseed Delinters and Methods," which is incorporated herein by reference for all purposes.

JOINT RESEARCH AGREEMENT

The presently claimed invention was made by or on behalf of the below listed parties to a joint research agreement. The joint research agreement was in effect on or before the date the claimed invention was made and the claimed invention was made as a result of activities undertaken within the scope of the joint research agreement. The parties to the joint research agreement are 1) Cotton Incorporated and 2) The United States Department of Agriculture.

BACKGROUND

The present disclosure relates generally to processing cottonseeds or other seeds, and more particularly, but not by way of limitation, to cottonseed delinters and methods.

Cotton is said to have been in use since prehistoric times and remains an important product in the world today for many purposes. Cotton grows in a cotton boll, which is a protective capsule, around the seeds of the cotton plant. With the Industrial Revolution, cotton began to be separated from the cottonseed with a cotton gin. Yet, after ginning the cottonseed, cotton linters (or cotton wool) remain on the cottonseed. Linters are fine, silky fibers that are typically less than ¼ of an inch (6.3 mm) or less than ⅛ of an inch (3 mm) long. Linters have a unique lumen and have many uses and potential uses. Linters are different than the longer staple lint and are not simply short pieces of residual staple lint. At times, other seeds also need removal of an exterior portion.

SUMMARY

According to an illustrative embodiment, a system for removing linters from ginned cottonseeds includes a rotatable drum having an exterior surface and an interior surface. The interior surface defines, at least in part, a cavity. The cavity has a first longitudinal-end opening and a second longitudinal-end opening. The system further includes a raised, longitudinal ridge member that extends longitudinally on the interior surface of the rotatable drum, a frame for rotatably supporting the rotatable drum, and a brush insert. The brush insert includes a spring frame having a first surface and a second surface. The spring frame has a first longitudinal seam edge and a second longitudinal seam edge and a first longitudinal edge and a second longitudinal edge. The spring frame is configured have a tubular position having an exterior diameter less than an interior diameter of the rotatable drum, and wherein, once inserted into the cavity of the rotatable drum, the spring frame is urged against the interior surface of the rotatable drum. The brush insert also includes a brush unit having a proximal base end and a filament end having a plurality of flexible filaments. The proximal base end is coupled to the first surface of the spring frame. The brush insert is disposed in the cavity with the second surface of the spring frame proximate the interior surface of the rotatable drum. The first longitudinal seam edge and the second longitudinal seam edge are configured to abut a portion of the raised, longitudinal ridge member on the interior surface of the rotatable drum. The system further includes a first rotation device operably coupled to the rotatable drum for rotating the rotatable drum relative to the frame in a first direction such that a centrifugal force urges the cottonseeds in the rotatable drum against the brush insert.

The system also includes a first end plate substantially covering the first longitudinal-end opening of the cavity, a second end plate substantially covering the second longitudinal-end opening, a cottonseed-introduction aperture fluidly coupled to the cavity for introducing cottonseeds having linters into the cavity, and a plurality of longitudinal brushes. Each longitudinal brush of the plurality of longitudinal brushes is rotatably coupled to the first end plate and the second end plate and each longitudinal brush has brush elements that are configured to bias the cottonseeds having linters against the brush insert on the interior surface of the rotatable drum. The system further includes a second rotation device operably coupled to at least one of the plurality of longitudinal brushes, for rotating the at least one of the longitudinal brushes in a second direction, a linter-removal aperture fluidly coupled to the cavity and to a reduced-pressure source for removing linters from the cavity, and a seed-removal conduit fluidly coupled to the cavity for removing the cottonseeds after delinting.

According to another illustrative embodiment, a system for removing at least a portion of an exterior of a plurality of seeds includes a rotatable drum having an exterior surface and an interior surface. The interior surface defines, at least in part, a cavity, and the cavity has a first longitudinal-end opening and a second longitudinal-end opening. The system also includes a raised, longitudinal ridge member that extends longitudinally on the interior surface of the rotatable drum, a frame for rotatably supporting the rotatable drum, and a brush insert.

The brush insert includes a spring frame having a first surface and a second surface. The spring frame has a first longitudinal seam edge and a second longitudinal seam edge and a first longitudinal edge and a second longitudinal edge. The spring frame is configured have a tubular position having an exterior diameter less than an interior diameter of the rotatable drum. The spring frame is urged against the interior surface of the rotatable drum when inserted. The brush insert also has a brush unit having a proximal base end and a filament end having a plurality of flexible filaments. The proximal base end is coupled to the first surface of the spring frame. The brush insert is disposed in the cavity with the second surface of the spring frame proximate the interior surface of the rotatable drum. The first longitudinal seam edge and the second longitudinal seam edge are configured to abut a portion of the raised, longitudinal ridge member on the interior surface of the rotatable drum when installed.

The system further includes a first rotation device operably coupled to the rotatable drum for rotating the rotatable drum relative to the frame in a first direction such that a centrifugal force urges the seeds in the rotatable drum against the brush insert. The system also includes a first end plate substantially covering the first longitudinal-end opening of the cavity, a second end plate substantially covering the second longitudinal-end opening, a seed-introduction aperture fluidly coupled to the cavity for introducing seeds having an exterior portion to be removed into the cavity, and a plurality of longitudinal brushes. Each longitudinal brush of the plurality of longitudinal brushes is rotatably coupled proximate to the first end plate and the second end plate. Each longitudinal brush has brush elements that are configured to bias the seeds against the brush insert on the interior surface of the rotatable drum. The system further includes a second rotation device operably coupled to at least one of the plurality of a longitudinal brushes, for rotating the at least one of the longitudinal brushes in a second direction, a removal aperture fluidly coupled to the cavity and to a reduced-pressure source for removing any matter removed from the plurality of seeds from the cavity, and a seed-removal conduit fluidly coupled to the cavity for removing the seeds after at least a portion of the exterior of the seeds has been removed.

According to still another illustrative embodiment, a method for removing linters from at least two sets of ginned cottonseeds without contamination is presented. The method includes inserting the first set of ginned cottonseeds into a rotatable drum having an interior surface with a first brush insert against the interior surface. The brush insert has brush filaments. The method further includes positioning a first end plate and a second end plate proximate to the rotatable drum to substantially seal a cavity in which the first set of ginned cottonseeds is disposed and rotating the rotatable drum in a first direction to cause the first set of ginned cottonseeds to press against the brush filaments of the first brush insert.

The method also involves rotating a plurality of longitudinal brushes that extend longitudinally within the rotatable drum and that are configured to further press the first set of cottonseeds against the brush filaments of the first brush insert. The plurality of longitudinal brushes is rotated in a second direction. The action of the first set of ginned cottonseeds pressing against the brush filaments of the first brush insert over time removes the linters from the first set ginned cottonseeds to produce a first set of cleaned seeds and a first set of linters. The method further involves removing linters that have been removed from the first set of ginned cottonseeds, removing the cleaned seeds prepared from the first set of ginned cottonseeds, removing at least a portion of the first end plate or the second end plate from the rotatable drum to provide access to the cavity, removing the first brush insert, and installing a second brush insert.

The method also involves cleaning or replacing the plurality of longitudinal brushes, repositioning the first end plate or second end plate proximate to the rotatable drum, inserting a second set of ginned cottonseeds into the rotatable drum, rotating the rotatable drum to cause the second set of ginned cottonseeds to press against the brush filaments of the second brush insert, and rotating the plurality of longitudinal brushes to cause the second set of ginned cottonseeds to further press against the second brush insert. The action of the second set of ginned cottonseeds pressing against the brush filaments of the second brush insert over time removes the linters from the second set of ginned cottonseeds to produce a second set of cleaned seeds and a second set of linters. The method further includes removing the second set of linters and removing the second set of cleaned seeds.

Other features and advantages of the illustrative embodiments will become apparent with reference to the drawings and detailed description that follow.

DETAILED DESCRIPTION OF ILLUSTRATIVE EMBODIMENTS

Figure 1:
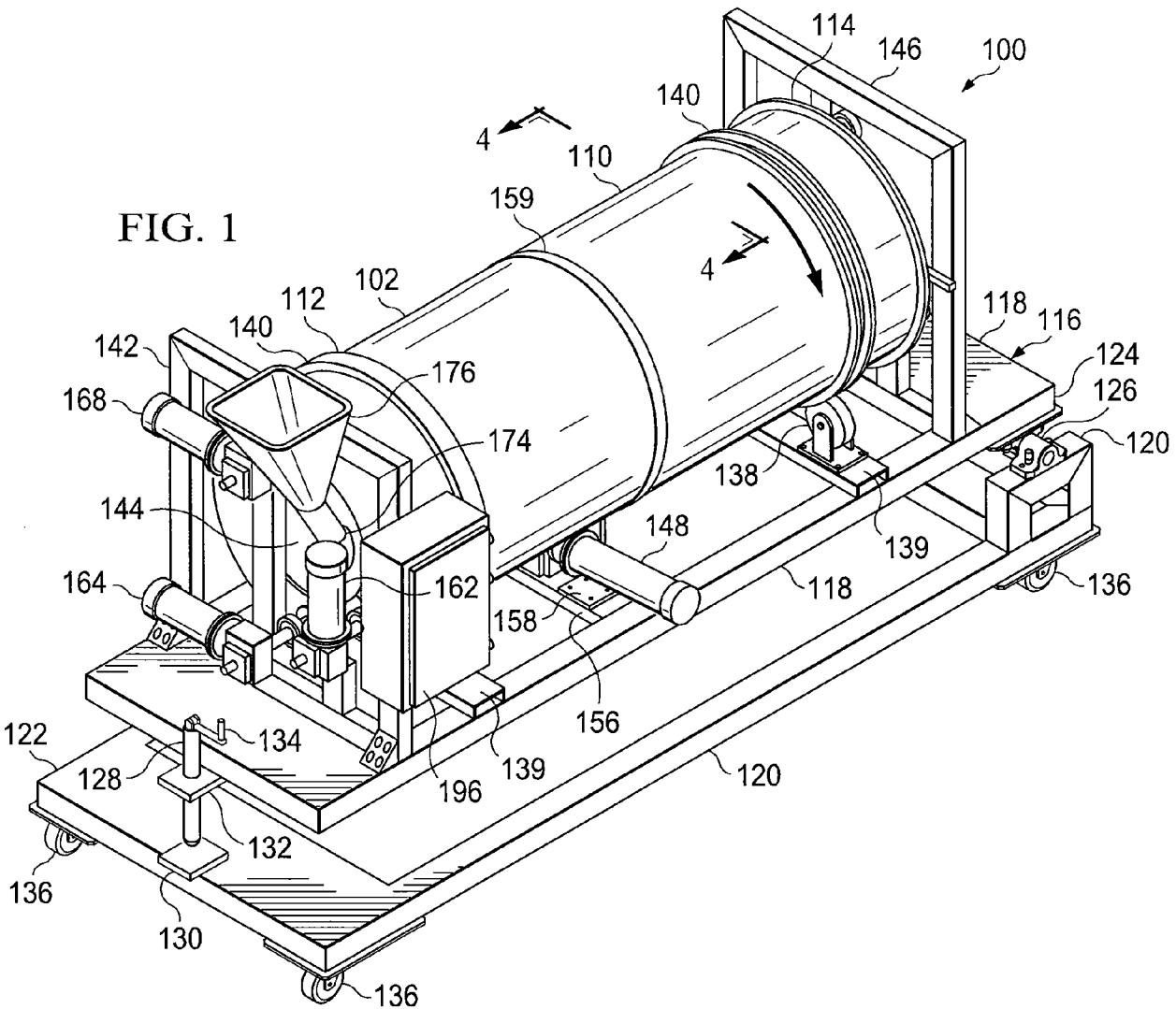
FIG. 1 is a schematic, perspective view of an illustrative system for delinting linters from a plurality of cottonseed.

In the following detailed description of the illustrative embodiments, reference is made to the accompanying drawings that form a part hereof These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Referring primarily to FIGS. 1-5, a system 100 for removing linters from ginned cottonseed 101 is presented. The system 100 removes linters and produces processed (or delinted) cottonseeds. The system 100 utilizes a rotatable drum 102 that receives the ginned cottonseeds into a cavity 104 in the rotatable drum 102. The rotation of the rotatable drum 102 causes the cottonseeds to impinge upon a flexible abrasive member 106 that is coupled to an interior surface 108 of the rotatable drum 102.

The rotatable drum 102 has an exterior surface 110, the interior surface 108, and an interior diameter, $D_1$. The rotatable drum 102 also has a longitudinal length that extends from a first longitudinal end 112 to a second longitudinal end 114. The rotatable drum 102 may have an aspect ratio (long dimension/diameter) in the range of 1 to 8. In one embodiment tested, the aspect ratio was approximately 2.6, but any number in the range given may be used and even outside the range in some embodiments. The rotatable drum 102 may be formed in any fashion to present a drum structure. In one embodiment, the rotatable drum 102 is formed as a rolled steel tube.

Figure 5:
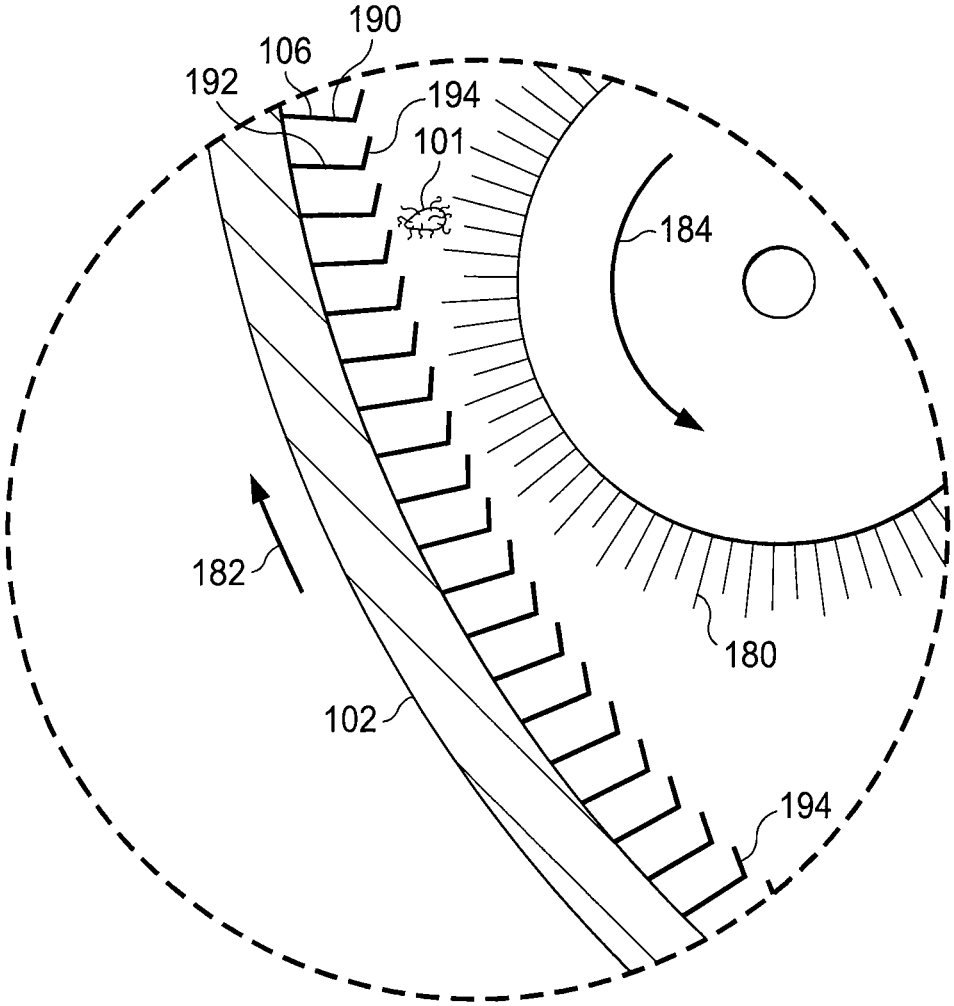
FIG. 5 is a detail of FIG. 4.

The interior surface 108 of the rotatable drum 102 is substantially covered by the flexible abrasive member 106, which may be a wire bristle brush or may be a card wire brush. The flexible abrasive member 106 may be coupled to the interior surface 108 of the rotatable drum 102 using an adhesive, epoxy, weld, UV weld, IR weld or any other attachment technique. The flexible abrasive member 106 and interior of the rotatable drum 102 could have mating slots to secure the flexible abrasive member 106 in the rotatable drum 102 and to facilitate removal and replacement. The flexible abrasive member 106 may be a card wire brush 190 having brush teeth 192 or filaments, which have an angled portion 194. The angled portion 194 may angle in the same direction as the first direction 182 of rotation as shown in FIG. 5. The card wire brush 190 may be a cardwire brush of the type used in textile machines. The flexibility of the flexible abrasive member 106 may help to avoid damage to the cottonseed. The teeth 192 on the card wire may be angled to grip the cottonseeds 101 and move them against gravity, i.e., up the drum wall (interior of the drum 102) for the orientation shown.

The system 100 includes a frame 116. The frame 116 may comprise a first frame 118 and a second frame 120. The frame 116 may have a first longitudinal end 122 and a second longitudinal end 124. A pivot connection 126 may be used to pivotally couple the first frame 118 and second frame 120 at second longitudinal end 124. A driving device 128, such as a jack or hydraulic lift, may be associated with the first frame 118 and second frame 120 at the first longitudinal end 122 of the frame 116 in order to create an angle between the first frame 118 and the second frame 120 about the pivot connection 126. The angle between the first frame 118 and the second frame 120 may be −5, −4, −3, −2, −1, 0, 1, 2, 3, 4, 5, 6, 7, 8, 9, 10, or more degrees.

The driving device 128 may include a first platform 130 that is coupled to the second frame 120 and a second platform 132 associated with the first frame 118 whereby when a hand crank 134 or other activating device is used to cause the platforms 130 and 132 to move apart, it causes a greater space to develop between the first longitudinal end of each of the frames 118 and 120. The driving device 128 thus causes relative movement between the first longitudinal end of the first and second frames 118, 120. The frame 116 is shown on wheels or casters 136. The frame 116 also includes a plurality of rotatable supports 138. Typically, at least two rotatable supports 138 per side are included, one set near the first longitudinal end 112 and one set near the second longitudinal end 114. The plurality of rotatable supports 138 may be displaced from one another and positioned to interface with one or more tracks 140 on the exterior 110 of the rotatable drum 102. The plurality of rotatable supports 138 may be mounted on lateral frame elements 139.

The frame 116 may further include a first longitudinal end frame 142. A first end plate 144 may be coupled to the first longitudinal end frame 142. The frame 116 may further include a second longitudinal end frame 146. A second end plate 145 is coupled to the second longitudinal end frame 146. As referenced below, bearing assembly and motors may be attached to the longitudinal end frames 142, 146. A control compartment 196 (FIG. 1) may be mounted on the longitudinal end frames 142 or 146 or elsewhere.

The control compartment 196 may include components for controlling the rotation devices 148, 162, 164, and 168. The control compartment 196 controls the rotation device 148 for the drum, which is run by a variable speed frequency drive, but does not necessarily need to be variable after the optimum is established. Also, rotation devices 164 and 162 may be consolidated into one motor that runs all the cleaning brushes. The rotation device 168, which turns the doffer brush 170, is also controlled by the control compartment 196. The driving device 128, if electrical, is also controlled at the control compartment 196.

An electrical motor or combustion engine, or other drive device, may function as a first rotation device 148. In the embodiment shown in FIG. 1, the first rotation device 148 comprises an electrical motor. The first rotation device 148 is operably coupled to a first drive assembly 150. The first drive assembly 150 may include a gear box 152 and rollers 154. The first drive assembly 150 may further include a drive belt 159 that extends around the exterior 110 of the rotatable drum 102. The first drive assembly 150 may be coupled to a lateral frame member 156 using securing plates 158. As shown best in FIG. 3, when the first rotation device 148 is activated, it turns a wheel 160 and causes the belt 159 to rotate. The belt 159 may be held in tension by the rollers 154. The first rotation device 148 is thus operably coupled to the rotatable drum 102 for rotating the rotatable drum 102 relative to the frame 116 in a first direction. While many approaches may be used for rotating the rotatable drum 102, the belt 159 secures the rotatable drum 102 and keeps the rotatable drum 102 from moving away from the rotatable supports 138.

The rotatable drum 102 rotates adequately to create a centrifugal force that urges the cottonseeds 101 with linters in the rotatable drum 102 against the flexible abrasive member 106. In one illustrative, embodiment, the first rotation device 148 is operable to rotate the rotatable drum 102 at a rotational speed greater than or equal to 170 revolutions per minute (RPM). In another example, the first rotation device 148 may rotate the drum at 250 RPM, 180 RPM, 170 RPM, 160 RPM, 150 RPM, 140 RPM, or another rotational speed. Whatever speed is selected should typically provide a centrifugal force to the cottonseed that urges the cottonseed against an interior 108 of the drum 102 and thereby against the flexible abrasive member 106. Other means of rotating the rotatable drum 102 may be implemented. The greater the rotational speed of the drum 102, the greater number of counter-rotating cleaning brushes 166.

In addition to securing the first end plate 144, the first longitudinal end frame 142 may also secure one or more rotation devices for rotating other components. For example, a second rotation device 162 and a third rotation device 164 may be coupled to the first longitudinal end frame 142. The second rotation device 162 and the third rotation device 164 may be used to rotate one or more of a plurality of longitudinal brushes 166 within the cavity 104. A fourth rotation device 168 may also be coupled to the first longitudinal end frame 142. The fourth rotation device 168 is operably coupled to rotate a doffer brush 170. Each longitudinal brush 166 may have a motor and could have a variable frequency drive to vary the speeds of each. The doffer brush 170 has a different drive device because the doffer brush 170 runs a different direction. Each drive device may have components associated with it to turn multiple longitudinal brushes 166.

Figure 6:
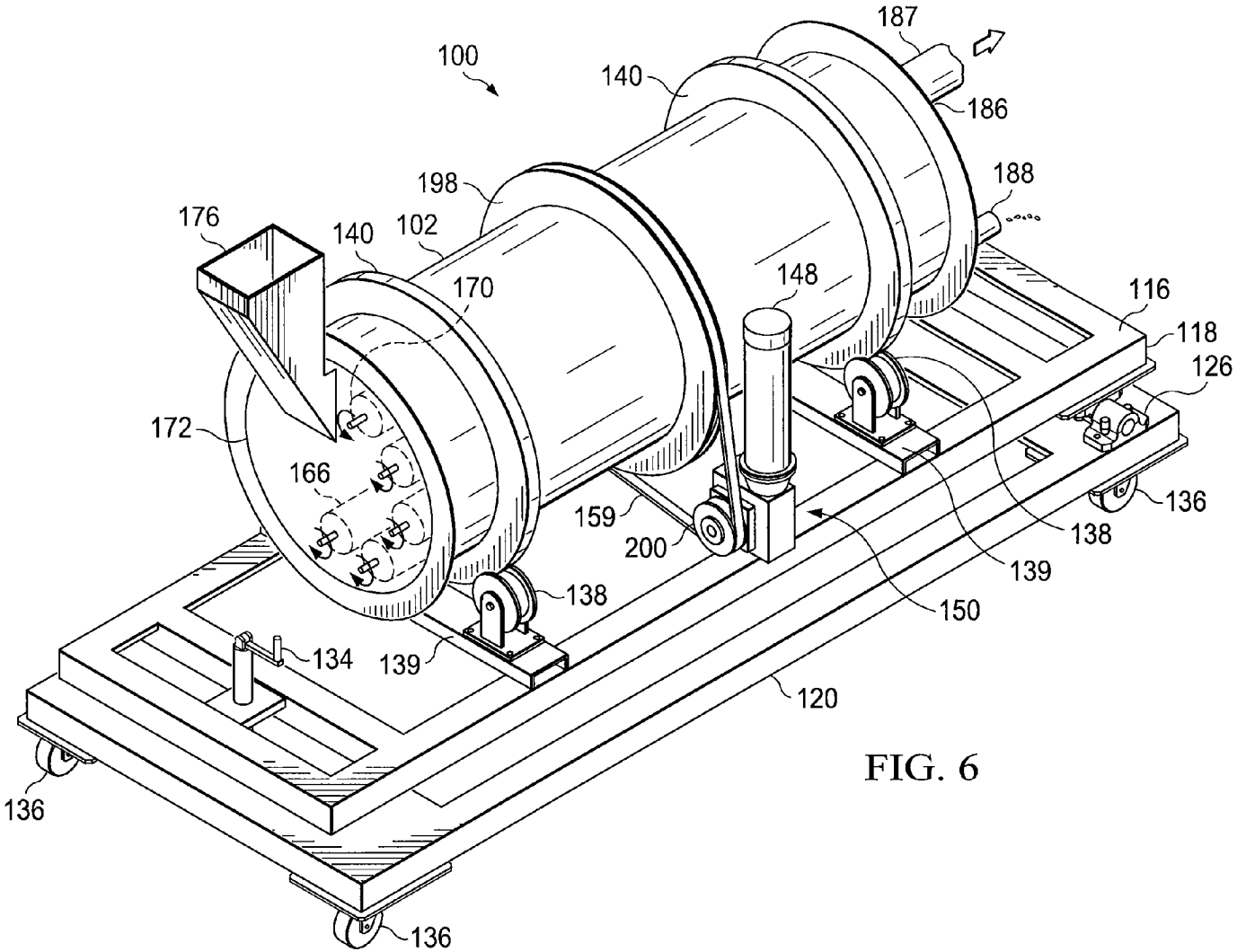
FIG. 6 is a schematic, perspective view, with a portion broken away, of another illustrative system for delinting linters from a plurality of cottonseed.

The first end plate 144 substantially covers a first longitudinal-end opening 172 (FIG. 6). Similarly, a second end plate 145 substantially covers a second longitudinal end opening of the cavity 104 (not shown but analogous to first longitudinal end opening 172). The first end plate 144 and second end plate may have bearings to rotatably suspend the plurality of longitudinal brushes 166 and the doffer brush 170. The end plates 144, 145 may include openings with seals, e.g., brush bristles, to help seal around the bearings or shafts of the longitudinal brushes 166 or doffer brush 170 that extend through the end plates 144, 145. In addition, belts, pulley, or gears may be coupled to the end plates 144, 145 to allow the rotation devices 162, 164, 168 to drive more than one brush or device. It will be appreciated that more or fewer rotation devices may be utilized depending on the number of belts or gears included. The longitudinal brushes 166 may rotate with speeds in the range of 40-800 RPM or any subset thereof.

A cottonseed-introduction aperture 174 is fluidly coupled to the cavity 104 for introducing ginned cottonseeds, which have linters, into the cavity 104. For example, the cottonseed-introduction aperture 174 may be formed on the first end plate 144. A seed funnel or hopper 176 may be operably coupled to the cottonseed-introduction aperture 174 to help deliver the ginned cottonseeds into the cavity 104. Alternatively, any suitable conveying device, such as a screw conveyor, could be used to introduce cottonseed into the cavity 104.

Figure 2:
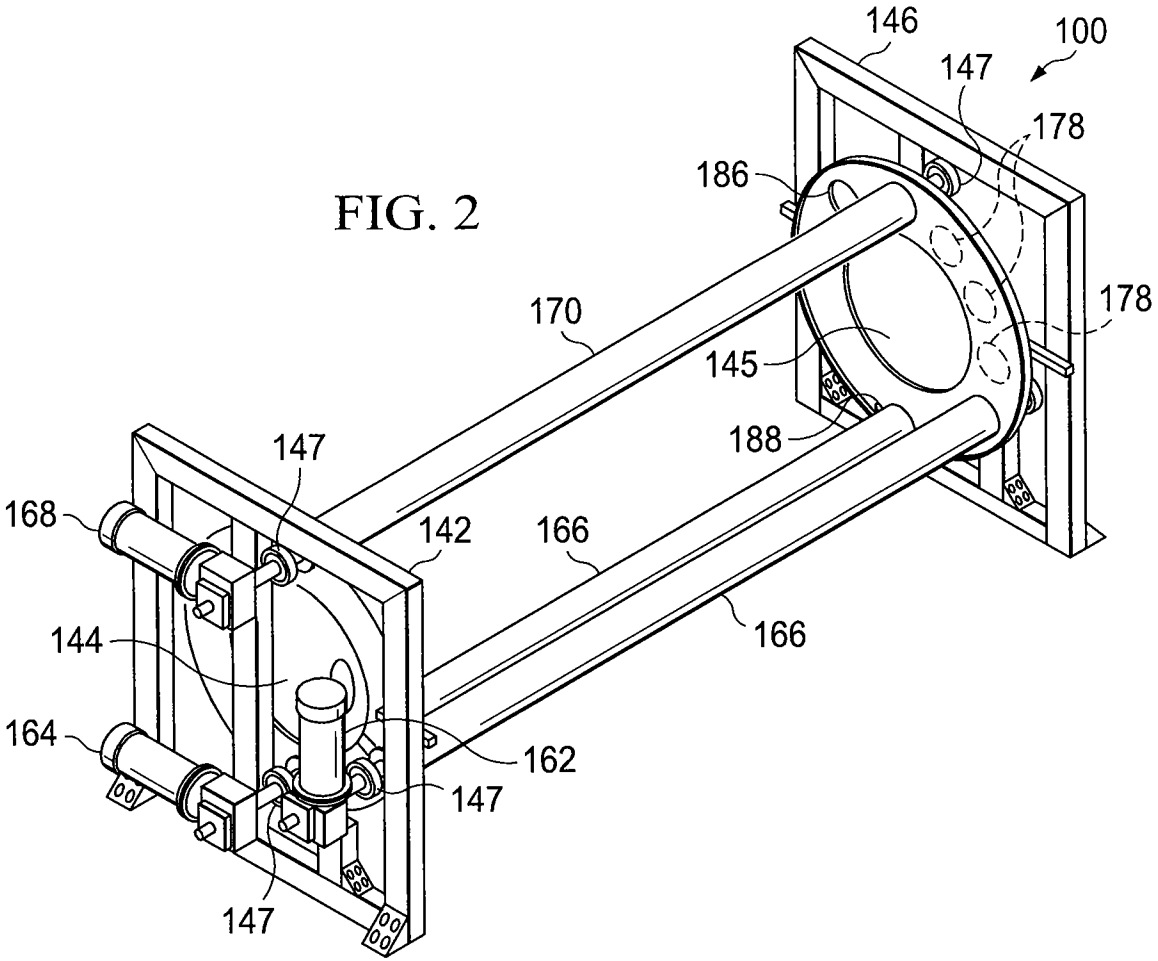
FIG. 2 is a schematic, perspective view of a portion of the system of FIG. 1 showing clearly the plurality of longitudinal brushes.
Figure 3:
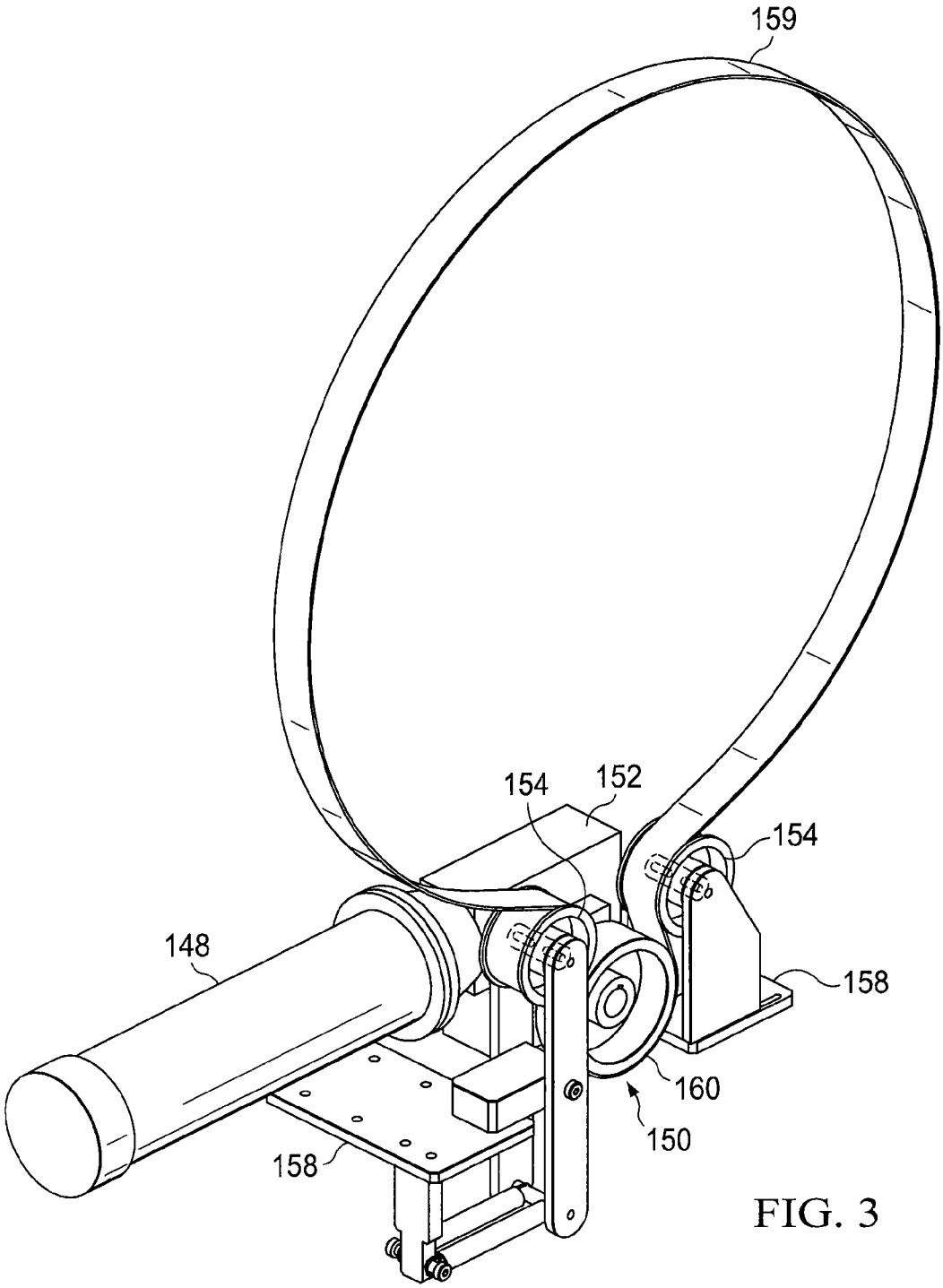
FIG. 3 is a schematic, perspective view of a portion of the system of FIG. 1 that causes the rotatable drum to rotate.

Referring now primarily to FIG. 2, a portion of the system 100 is shown with the rotatable drum 102 removed and the frame 116 removed along with associated components. Thus, the figure primarily shows the first longitudinal end frame 142 and the second longitudinal end frame 146 and the second end plate 145. The plurality of longitudinal brushes 166 are shown rotatably connected to the end plates 144, 145 with bearings 147. In addition, the doffer brush 170 is shown extending between the end plates 144, 145 and being supported by bearings 147. Thus, the longitudinal brushes 166 and doffer brush 170 may be rotatably suspended by the bearings 147. Broken lines 178 show the location of optional members of the plurality of longitudinal brushes 166. The plurality of longitudinal brushes 166 may extend from approximately six o'clock to twelve o'clock in the cavity 104 or any portion thereof. Typically, the longitudinal brushes 166 extend from a lowest point with respect to the gravity field to at or near the highest point with respect to the gravity field. Typically, at least 90 degrees of the cross sectional interior of the rotation drum 102 is covered by the longitudinal brushes 166.

While the doffer brush 170 may be located at other locations, the doffer brush 170 is shown at or near the most vertical position with respect to the gravity field, i.e., twelve o'clock in the cavity 104. The doffer brush 170 may also be at one o'clock or two o'clock or another location near an upper portion of the cavity 104. The longitudinal doffer brush 170 may be positioned approximately 0.5 centimeters beyond the tip of the flexible abrasive member 106. That is, for example, the tips of the doffer brush 170 may protrude into the card wire brush 106 past the tips so as to clean the card wire brush 106 and remove linters. The doffer brush 170 is operable to remove linters and other debris that may be caught within the flexible abrasive member 106. The fourth rotation device 168 may rotate the doffer brush 170 in the first direction 182, which is the same direction as the rotatable drum 102. Typically, the doffer brush 170 is rotated at a speed greater than the rotatable drum 102, e.g., at least two times or at least three times the angular speed of the rotatable drum 102. In some embodiments, the doffer brush 170 may be omitted.

In another embodiment, the doffer brush 170 may be coupled at a top portion (e.g., 11, 12, or 1 o'clock) in the cavity 104 and may be substantially enclosed by a trough (not shown). The trough prevents seeds from going against the doffer brush 170 but allows the flexible abrasive member 106 to enter the trough and come into contact with the doffer brush 170. The doffer brush 170 removes the linters from the flexible abrasive member 106. The extended conduit 187 for removing linters may be in the cavity 104 proximate to the trough and may remove linters pulled from the flexible abrasive member 106.

Figure 4:
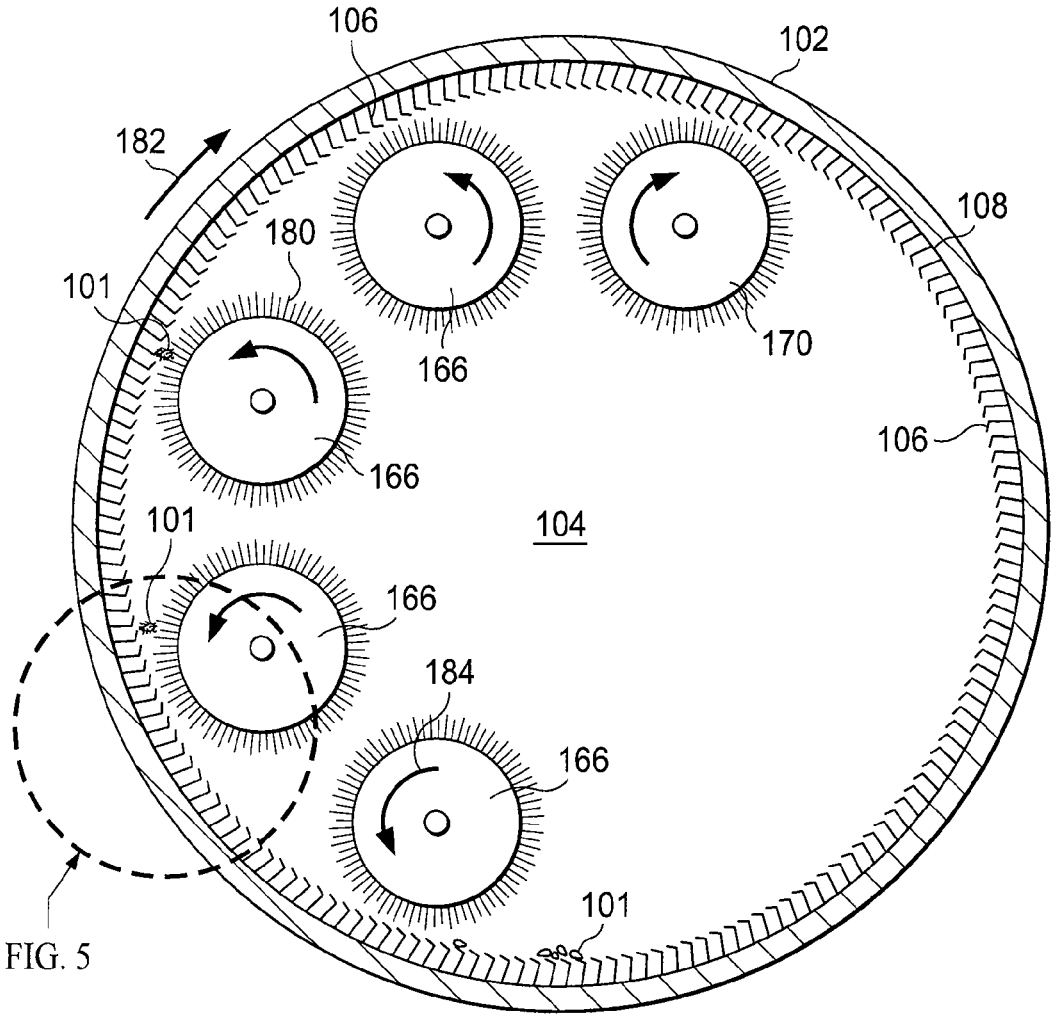
FIG. 4 is a schematic, cross-sectional view of the rotatable drum in FIG. 1 taken along line 4-4.

Each of the plurality of longitudinal brushes 166, as well as the doffer brush 170, is rotatably coupled to the first end plate 144 and the second end plate 145 with the bearings 147. One or more of the rotation devices 162, 164 are operable to rotate the plurality of longitudinal brushes 166 in a first or second direction, e.g., counter-clockwise. As shown in FIGS. 4 and 5, the plurality of longitudinal brushes 166 is positioned within cavity 104 such that brush elements 180 bias the cottonseeds 101 against the flexible abrasive member 106. Each longitudinal brush roller may rotate in a second direction 184 that is opposite to the first direction 182 of the rotatable drum 102.

The plurality of longitudinal brushes 166 may substantially cover the entire interior of the drum 102 except for the location of the doffer brush 170. Alternatively, the plurality of brushes 166 may cover only a portion of the interior of the drum 102. For example, the plurality of longitudinal brushes 166 may cover at least 90 degrees of the inside of the drum or the interior surface of the rotatable drum 102 beginning at a lowest point within the cavity 104 relative to a gravity field and spaced along the interior of the drum 102 in the direction of rotation of the rotatable drum 102. The plurality of longitudinal brushes 166 may all have the same inside diameter, $D_2$, or may have varying diameters, e.g., $D_3$, $D_4$, $D_5$, etc. In many embodiments, $D_2 < 1/4\ D_1$, or $D_2 < 1/8\ D_1$.

The second end plate 145 is formed with a linter-removal aperture 186 that is operably coupled to the cavity 104. The linter removal aperture 186 may receive reduced pressure from a vacuum source for removing linters from within the cavity 104. While not shown, the first end plate 144 may include a second linter-removal aperture to which a reduced-pressure source may be fluidly coupled. Thus, in some embodiment, linters may be removed at both ends. A conduit 187 is coupled to the linter removal aperture 186 and to the reduced-pressure source. The conduit 187 may extend into the cavity 104 and may run the length of the cavity 104 or some portion and may have apertures in the portion in the cavity. In this way, linters may be drawn into the conduit 187 from multiple locations within the cavity 104.

The second end plate 145 is also formed with a seed-removal conduit or aperture 188 fluidly coupled to the cavity 104 for removing the cottonseeds after delinting. The aperture 188 may have a valve or be configured to be opened only at discrete times. The seed-removal aperture 188 may optionally have a gate or valve (not explicitly shown) for controlling the removal of cottonseeds from the cavity 104. In this way, the cottonseeds 101 may be batched processed before the gate is opened to remove the cottonseeds. The cottonseed-introduction aperture 174 may be sized such that under reduced pressure delivered through the linter removal aperture 186, a reduced pressure is maintained within the cavity 104 that is greater than a minus 100 millimeters of mercury. In any event, an air flow is established from within the cavity and the seed-removal conduit 188 that is adequate to carry (suspend) the linters and slow enough not to carry the cottonseed. For example, without limitation, the airflow established may be −400 CFM to −1000 CFM.

Referring now generally to FIGS. 1-5, in operation according to one illustrative embodiment, the system 100 is activated such that the rotatable drum 102 is rotated with a speed between 60 and 170 RPM (although other speeds are possible as described herein). Ginned cottonseeds are introduced into the hopper 176 and thereby introduced into the cavity 104. The centrifugal force caused by the rotatable drum 102 acting on the ginned cottonseeds along with the longitudinal brushes 166 causes the cottonseeds to be worked upon.

When operating, the cottonseeds bounce around—looking somewhat like popcorn—as the seeds continue to climb the drum wall but then fall again to repeat the process. Cottonseeds fly out of longitudinal brushes 166 or come out the top near the duffer brush 170. The cottonseeds go in one end, e.g., first end 112, and out the other in a main embodiment. The centrifugal force holds or helps hold the cottonseeds with linters against the inside of the rotatable drum 102 so that the work can be accomplished that removes the linters. The work is accomplished by an abrasive surface of the flexible abrasive member 106 as the centrifugal force and the longitudinal brushes 166 urge the cottonseed against the flexible abrasive member 106. The cottonseed is moved against the gravity field by the rotation of the rotatable drum 102. The heat generated by this process is relatively less than many mechanical approaches and is easily maintained at less than 150° Fahrenheit and more typically less than 140° Fahrenheit. If the seed is to be used for purposes other than planting, the temperature may be allowed to go higher than 140° F.

When finished, the ginned cottonseeds may have all the linters removed and look as if the cottonseeds have been acid-delinted, i.e., smooth and black. But, because the cottonseeds have not been acid delinted, the processed cottonseeds may be stored relatively longer than acid-delinted cottonseeds. The processed cottonseeds may also be useful for food applications.

Referring now primarily to FIG. 6, another illustrative embodiment of a system 100 for removing linters from ginned cottonseeds is presented. The system 100 is analogous to the system 100 of FIGS. 1-5, except the end frames 142 and 146 have been removed (for demonstration purposes), a belt track 198 has been added, and the first rotation device 148 and first drive assembly 150 are slightly different. In this embodiment, the first rotation device 148 is oriented vertically or lined parallel with the gravity field. The first drive assembly 150 includes a single drive wheel 200 that engages the belt 159.

Many alternatives and additions to system 100 of FIGS. 1-6 are possible. In some embodiments, replacement of the flexible abrasive member 106 may be facilitated. For example, the end plates 144, 145 may be removable so that the flexible abrasive member 106 may be removed. A new flexible abrasive member 106 may be slid into the rotatable drum 102 and attached. The end plates 144 or 145 may then be restored to their initial position.

In another alternative embodiment, a positive air stream impinges on the cottonseeds such that "naked" or processed cottonseeds (no linters) can go by the air stream but the cottonseeds with linters cannot. The air stream is set such that the air stream develops a force on the cottonseeds having linters that removes them from the exit path. The cottonseeds without linters continue along the exit path. This allows for a continuous feed and a continuous removal from the system 100.

In another illustrative embodiment, the entry of cottonseeds into the cavity 104 through the hopper 176 is regulated, but continuous. The angle of the rotatable drum 102 with respect to the frame 116 may be varied to control the general rate of movement of the cottonseeds through the cavity 104. The exit to the seed-removal conduit or aperture 188 may be regulated to only receive cottonseeds that have been delinted by using an air stream as previously described. After passing the regulated exit, the processed cottonseeds may still contain waste, e.g., pieces of stem, leaf, carpel, boll and other non-cottonseed material that remains with the seed after ginning. A second separator (air steam device) may be used to remove such waste.

In still another embodiment, the rotatable drum 102 has a longitudinal hinge (not shown) and a fastened portion to form a clam-like structure that is moveable between a closed position and open position. When one desires to gain access to the cavity 104 to replace the flexible abrasive member 106, the fastened portion is released, i.e., one or more fasteners are released, and the rotatable drum 102 opens about the longitudinal hinge to the opened position. In this way, the flexible abrasive member 106 may be replaced or cleaned. This embodiment may be particularly attractive in a small table-top embodiment of the system 100 for use with seeds for planting since a cleaning or replacement of the flexible abrasive member 106 would typically be required between every batch. It should be noted that the systems 100 herein may be scaled for a table-top size to a large industrial gin size.

In another embodiment, one of the end plates 144, 145 may be hinged or removed to gain access to the cavity 104. This may require removing the bearings 147 associated with the longitudinal brushes 166 and the doffer brush 170. In another embodiment, an access door (not shown) may be on at least one of end plates 144, 145 and the flexible abrasive member 106 may have channels and the rotatable drum 102 grooves (or vice versa) that interface and allow the flexible abrasive member 106 to be slid out of the rotatable drum 102 for replacement.

In one particular embodiment that was tested in part, the rotatable drum 102 had a longitudinal length of approximately 93 inches and an inside diameter of approximately 36 inches. Thus, the aspect ration was approximately 2.58. The doffer brush 170 had an outside diameter of approximately 4.8 inches. The longitudinal brushes 166 were uniform and had an outside diameter of approximately 4.7 inches. The first rotation device 148 was a five horsepower electric motor used to turn the rotatable drum 102 in a first direction (e.g., clockwise). The second rotation device 162 was a three horsepower electric motor that had belts and pulleys associated with it to turn the plurality of longitudinal brushes 166 in a second direction (counter-clockwise). The fourth rotation device 168 was a three horsepower electric motor used to turn the doffer brush 170 in the first direction (e.g., clockwise). This system 100 was operable to fully process ginned cottonseeds in batches in ten minutes with typically 20 pounds of seeds being processed. The system 100 was able to process between 100 and 150 pounds of ginned cottonseeds an hour. In another embodiment, the dimensions were the same, but ¾ horsepower motors were associated as the driving devices with each longitudinal brush 166. The listed power of the motors is for illustrative purposes in one embodiment and could be any size for the given purpose. For example, in another analogous embodiment, the first rotation device 148 in the same system may have a 30 horsepower motor. Other power ratings are contemplated.

In one embodiment, the seed-removal conduit 188 has a gate or valve for controlling or regulating the removal of cottonseeds 101 from the cavity 104 and the cottonseed-introduction aperture 174 is sized such that under reduced-pressure from the linter-removal aperture 186, a reduced-pressure is maintained in the cavity 104 that is greater than −100 mm Hg.

Referring now primarily to FIGS. 7-11, another illustrative embodiment of a system 300 for removing linters from ginned cottonseeds is presented. While the system 300 is particularly well suited for removing linters from ginned cottonseed, it should be understood that as with other embodiments herein other seeds might be processed with the same system. In this regard, the system 300 may be used to remove an exterior portion of any seed. For example, a portion of a barley seed may be removed, rice may be polished, or exterior portions of wheat or peas removed.

The system 300 includes a rotatable drum 302 having an exterior surface 310 and an interior surface 308. The interior surface 308 defines, at least in part, a cavity 304. The cavity 304 has a first longitudinal end 312 with an opening and a second longitudinal end 314 with an opening. The interior surface 308 is formed with a raised, longitudinal ridge member 303, or key, that extends longitudinally on the interior surface 308 of the rotatable drum 302. The raised, longitudinal ridge member 303 is used to help hold a brush insert 306 in position as described elsewhere. The rotatable drum 302 may be formed with flanges 305 on each end 312, 314. The rotatable drum flanges 312, 305 may mate, nestle, or abut with flanges 377 on the end plates 344, 345.

The rotatable drum 302 is rotatably supported by a frame 316. The frame 316 may include a first frame 318 and a second frame 320. The frame 316 has a first longitudinal end 322 and a second longitudinal end 324. The first and second frames 318 and 320 are rotatably coupled by a pivot connection 326, or hinge, proximate the second longitudinal end 324. A driving device 328 may be used to move the frames 318, 320 about the pivot connection 326 relative to each other. This allows an angle to be assumed between the frames 318, 320. Thus, the rotatable drum 302 may assume many angles since the rotatable drum 302 is coupled to the frame 316. The driving device 328 may be a hand crank 334 like a jack, a motorized life, hydraulic lift, or other device. The frame 316 may be on casters or wheels. Additional, support members 335 that include pivots 337 may be applied to provide additional supports for the frames 318, 320. The support members 335 are extendable and retractable to accommodate the angle formed between the frames 318, 320. Once the support members 335 are positioned, the support members 335 extend from the support surface to the frame 316.

A plurality of rotatable supports 338 may be used to support the rotatable drum 302 while allowing the rotatable drum 302 to rotate. The rotatable supports 338 may be passive or may provide a rotational drive force to actively rotate the rotatable drum 302. In the present illustrative embodiment, the rotatable supports 338 are passive and a separate rotation device 348 is used to rotate the rotatable drum 302. In one embodiment, the rotatable supports 338 are wheels. The rotatable supports 338 may be coordinated with one or more tracks 340 on the exterior 310 of the rotatable drum 302.

The rotatable drum 302 may be rotated in many ways. For example, the rotatable supports 338 may be directly driven, a gear may be applied from a motor to a mating portion of the exterior surface 102, a drive belt may be used, or other motive force applied. The drive belt approach is shown in the present illustrative embodiment. Thus, the rotation device 348 is coupled by linkage or drive assembly 350 to a drive wheel 400 and a drive belt 359 is in tension against the drive wheel 400 and rotatable drum 302. Other intermediate wheels or rollers 354 may be included.

A first end plate 344 substantially covers the first longitudinal end 312 opening of the cavity 304. A bushing may be applied between the first end plate 344 where the first end plate 344 would otherwise contact the rotatable drum 302 at the first longitudinal end 312. The bushing may be desirable since there is relative rotation between the first end plate 344 and the rotatable drum 302 that causes friction but needs to be sufficiently sealed. The bushing may comprise one or more of the following: a TEFLON material, ceramic material, PTFE (polytetrafluoroethylene), PFA (perfluoroalkoxy), or FEP (Fluorinated ethylene propylene) or other material that can endure the friction-created heat. The first end plate 344 may be formed wholly or partially from a see-through material such as a LEXAN material, PLEXIGLAS material, or acrylic material, clear PVC, etc. The material allows an operator to view the work being accomplished in the rotating drum 304.

Figure 10:
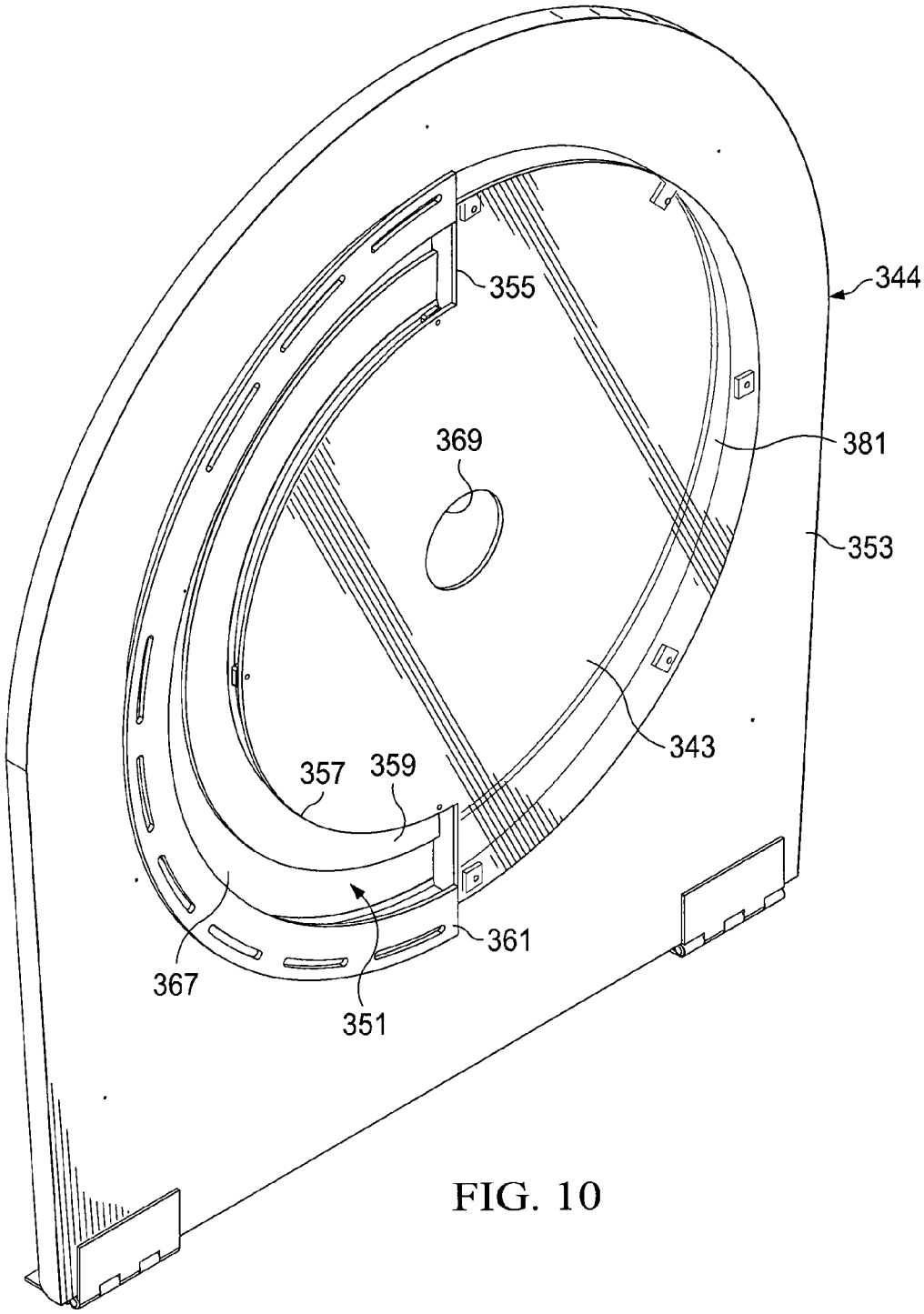
FIG. 10 is a schematic, perspective view of an endplate of the system of FIG. 7.

As shown most clearly in FIG. 10, the first end plate 344 may include a see-through portion 343, a brush portion 351, and a frame portion 353. The see-through portion 343 may allow viewing in the cavity 304 by operators. The brush portion 351 allows drive shafts from the rotation devices to extend into the cavity 304 and yet still be adjustable, i.e., capable of being moved relative to the rotatable drum 302. The see-through portion 343 may be coupled to the frame portion 353 using a bracket 381, fasteners, or other means. A bracket 355 may be coupled to a portion of a peripheral edge 357 of the see-through portion 343 to which a first brush segment 359 is coupled. Another bracket 361 or other retention device is coupled to a complimentary portion of the frame portion 353 and is coupled to a second brush segment 367. Assembled, the brush segments 359, 367 (collectively 351) allow a drive shaft to extend into the cavity 304. The longitudinal brushes may be coupled to the end plates using any technique such as a bracket with a spindle or rotatable connect. The see-through portion 343 is formed with an aperture 369, or seed-introduction aperture, for receiving seeds, such as ginned cottonseeds or other seeds to be processed by system 300. The aperture 369 is fluidly coupled to the cavity 304. The other end plate 345 is analogous in most respects.

Figure 7:
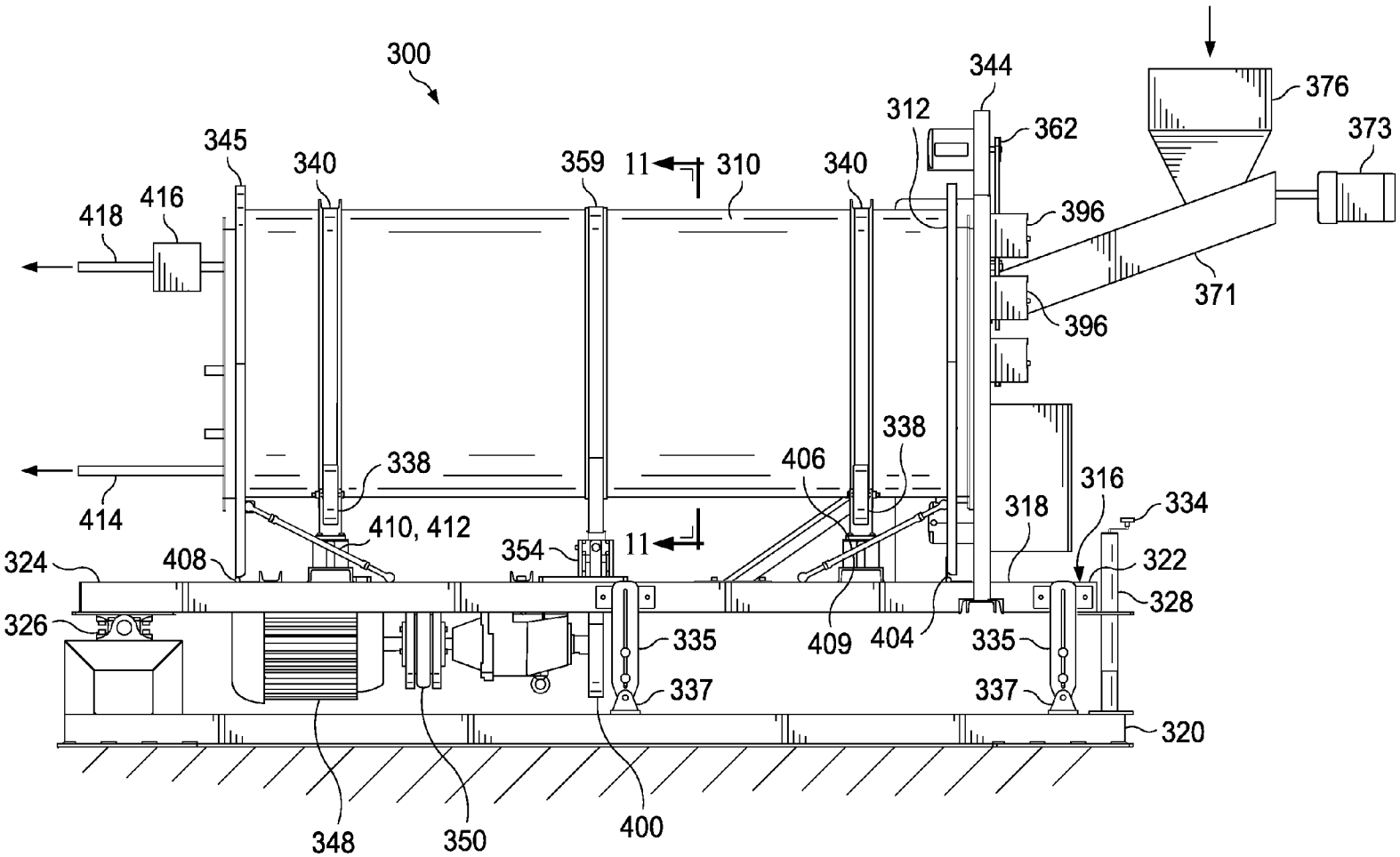
FIG. 7 is a schematic, side elevation view of an illustrative system for delinting linters from a plurality of cottonseeds or removing an exterior portion of a plurality of seeds.

As shown in FIG. 7, an auger or feed mechanism 371 may interface with the first endplate 344 and in particular with the see-introduction aperture 369. The feed mechanism 371 includes an auger or other motive device driven by motor 373 to introduce seeds into the cavity 304. The seeds may be introduced into the feed mechanism 371 through a hopper 376.

The first end plate 344 is pivotably coupled by a hinge or pivot 404 to the frame 316. A first fastener 406, such a clasp or a turnbuckle 409 or other device, is used to releasably secure the first end plate 344 in a closed position. In one embodiment, after any items in front of the first end plate 344 are removed, the first fastener 406 may be removed and the first end plate 344 pivoted about pivot 404 to gain access to the cavity 304. Thus, the first end plate 344 has a closed position proximate to the rotatable drum 302 and an open position that allows access to the cavity 304.

The second end plate 345 is analogous to the first end plate 344 in most respects. As shown primarily in FIG. 9, the second end plate 345 may have a see-through portion 343 and brush segments 359, 367, and the like. The second end plate 345 is, however, formed with different aperture arrangement. The second end plate 345 is formed with a seed-removal aperture 383 for removing the processed seeds that are then delivered or fluidly coupled to processed seed off take, or seed removal conduit 414 (FIG. 7). Similarly, the other aperture 385 may be a linter-removal aperture or material-removal aperture used to remove other material that has been removed the exterior of the seeds. A reduced pressure may be developed by a vacuum pump 416 (FIG. 7) and delivered to the second aperture 385. In this way, linters or other material removed from the seeds may be encouraged to enter the second aperture 385 and are then delivered to a linter or seed-material off take 418. The second end plate 345 may also be pivotably coupled by a hinge or pivot 408 and held in a closed position by a fastener 410, such as a turnbuckle 412. The fastener 410 may be coupled to a bracket 413 on the second end plate 345 and to a mounting bracket 415 on a lateral portion of frame 416. Thus, the second end plate 345 has a closed position proximate to the rotatable drum 302 and an open position that allows access to the cavity 304. As with the first end plate 344, a bushing may included between the second end plate 345 and the rotatable drum 302.

Figure 11:
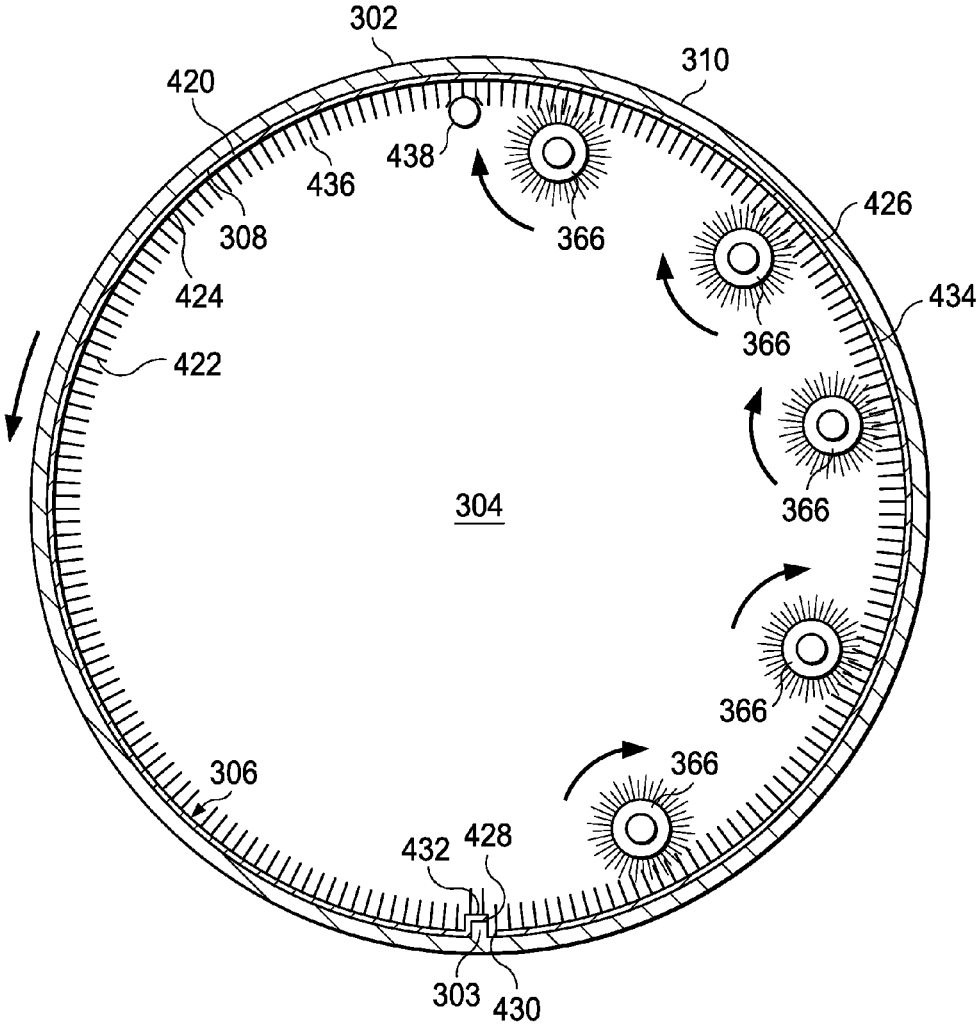
FIG. 11 is a schematic, cross-sectional view of a portion of the rotatable drum in FIG. 7 taken along line 11-11.

As shown clearly in the cross-sectional view of FIG. 11, the brush insert 306 includes a spring frame 420 and a brush unit 422. The spring frame 420 includes a first surface 424, which is shown inward facing, and a second surface 426. The spring frame 420 has a first longitudinal seam edge 428 and a second longitudinal seam edge 430. The spring frame 420 extends the length of the rotatable drum 302 or some portion thereof and thus has a first longitudinal edge configured to be proximate the first longitudinal end 312 of the rotatable drum 302 and a second longitudinal edge configured to be proximate the second longitudinal end 314 when installed in the cavity 304 of the rotatable drum 302. The spring frame 420 is configured to assume tubular position when loaded with an exterior diameter less than an interior diameter of the rotatable drum 302 and yet be urged to unfold or spring outward, whereby the spring frame 420 is urged against the interior surface 308 of the rotatable drum 302.

A lip 432 may be formed proximate the first longitudinal seam edge 428 that abuts and extends over the raised, longitudinal ridge member 303. The lip 432 facilitates removal of the brush insert 306 from the cavity 304 during replacement. The lip 432 may be moved away from the raised, longitudinal ridge to cause at least one of the longitudinal edges 428, 430 to no longer abut the raised, longitudinal member 303.

The brush unit 422 has a proximal base end 434, or surface, and a filament end 436 having a plurality of flexible filaments or teeth. The proximal base end 434 is coupled to the first surface 424 of the spring frame 420. The proximal base end 434 may be coupled to the first surface 424 using bonding, adhesives, cements, stitching, staples, hook-and-loop fasteners, or other coupling devices.

The brush insert 306 is disposed in the cavity 304 with the second surface 426 of the spring frame 420 proximate the interior surface 308 of the rotatable drum 304. The first longitudinal seam edge 428 and the second longitudinal seam edge 430 are configured to abut a portion of the raised, longitudinal ridge member 303 on the interior surface 308 of the rotatable drum 302. In another embodiment, the first longitudinal seam edge 428 and the second longitudinal seam edge 430 may abut each other. As previously mentioned, the lip 432 may be included to help remove dislodge the abutment of the first longitudinal seam edge 428 and the second longitudinal seam edge 430 with the raised, longitudinal ridge member 303. The lip 432 thereby facilitates removal of the brush insert 306 from the cavity 304.

The brush insert 306 may be formed with a plurality of segments or as a single integral unit. The plurality of segments may be desirable if different filament rigidities are desired for different segments. For example, the first segment (most upstream) may include a more rigid brush and the final (downstream) segment may have the least rigidity for polishing. Numerous permutations are possible for the segments.

The brush unit 422 may be formed from many different types of brush designs. The filaments of the brush insert 306 will, however, typically be in the range of 0.5 to 2.5 inches in length for cottonseeds. Other seeds may have a different range. Moreover, the filaments may have abrasive grit applied along their length. A few non-limiting, illustrative examples include the following: 3M BRUSHLON 420B, grade 46×⅞; 3M BRUSHLON 420B, grade 120×⅞; 3M BRUSHLON 420B, grade 180×1.5; abrasive nylon brushes/brush pads; silicon carbide brushes; polystyrene brushes; polyester brushes; PEEK material brushes, or brushes formed from polyethelene, polypropylene, polystyrene, PTFE, Thunderon® material, or Tynex. The brushes and brush types listed are merely for illustrative purposes, and clearly other brushes are contemplated that function to remove an exterior portion of the seeds.

The rotatable drum 302 is rotated by the first rotation device 348 relative to the frame 316 in a first direction such that a centrifugal force urges the seeds in the rotatable drum 302 against the brush insert 306. The rotatable drum 302 is typically rotated at a speed in the range of 100 to 300 RPM. In addition, a plurality of longitudinal brushes 366 is used to further urge the seeds against the brush insert 306.

Each longitudinal brush of the plurality of longitudinal brushes 366 is rotatably coupled to the first end plate 344 and the second end plate 345. The longitudinal brushes 366 may be coupled with rotatable couplings on a bracket, a superstructure or at the end, or may be coupled using any another approach. As noted elsewhere, the shafts of the longitudinal brushes 366 may extend to through brush segments of the end plates 344, 345 to facilitate adjustment of the positions of the longitudinal brushes 366. Each longitudinal brush 366 has brush elements or filaments that are configured to bias the seeds against the brush insert 306 on the interior surface 308 of the rotatable drum 302. The filaments or teeth of the longitudinal brushes 366 may engage or overlap the filaments of the brush unit 422.

Figure 8:
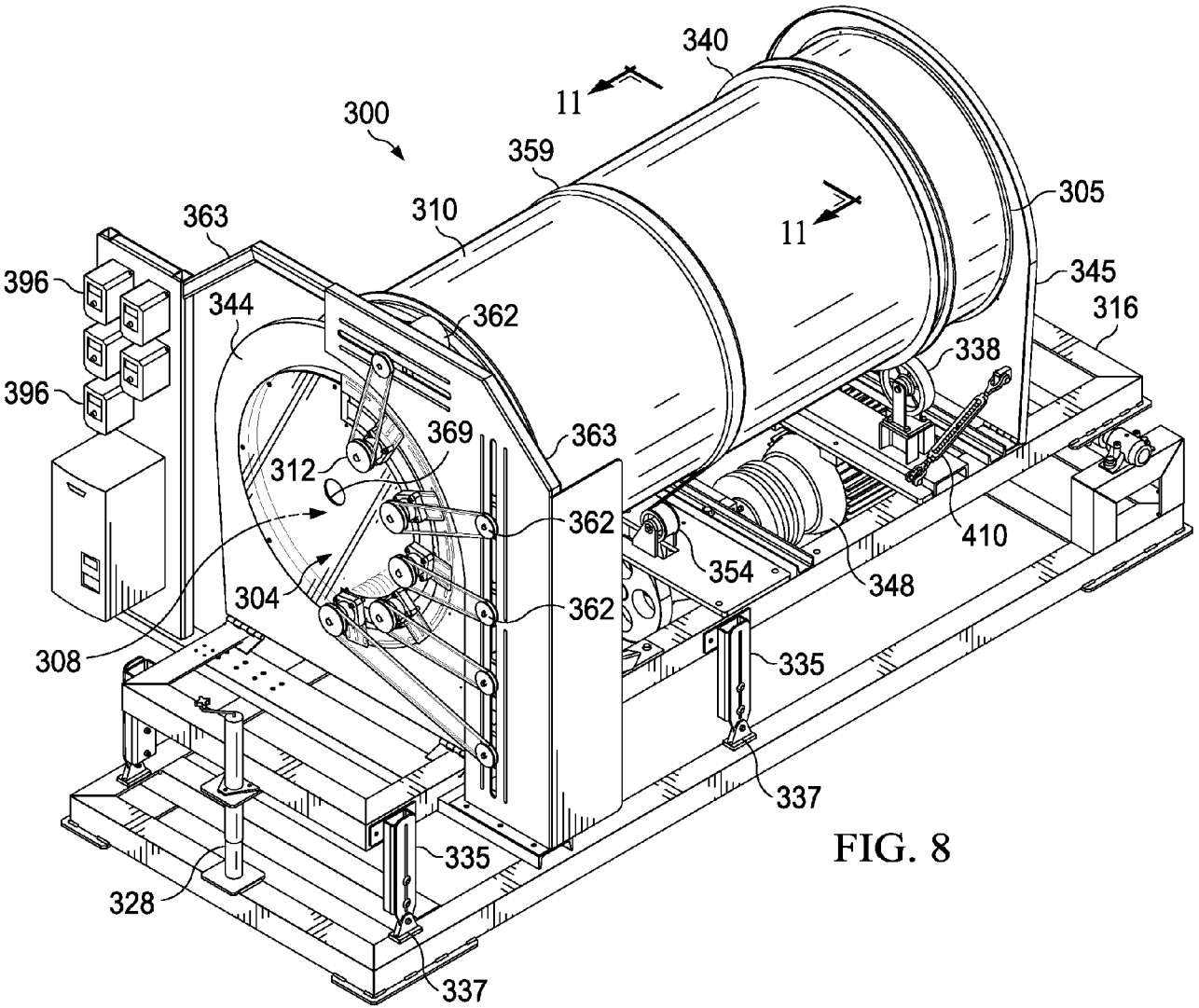
FIG. 8 is a schematic, perspective view of a portion of the system of FIG. 7.
Figure 9:
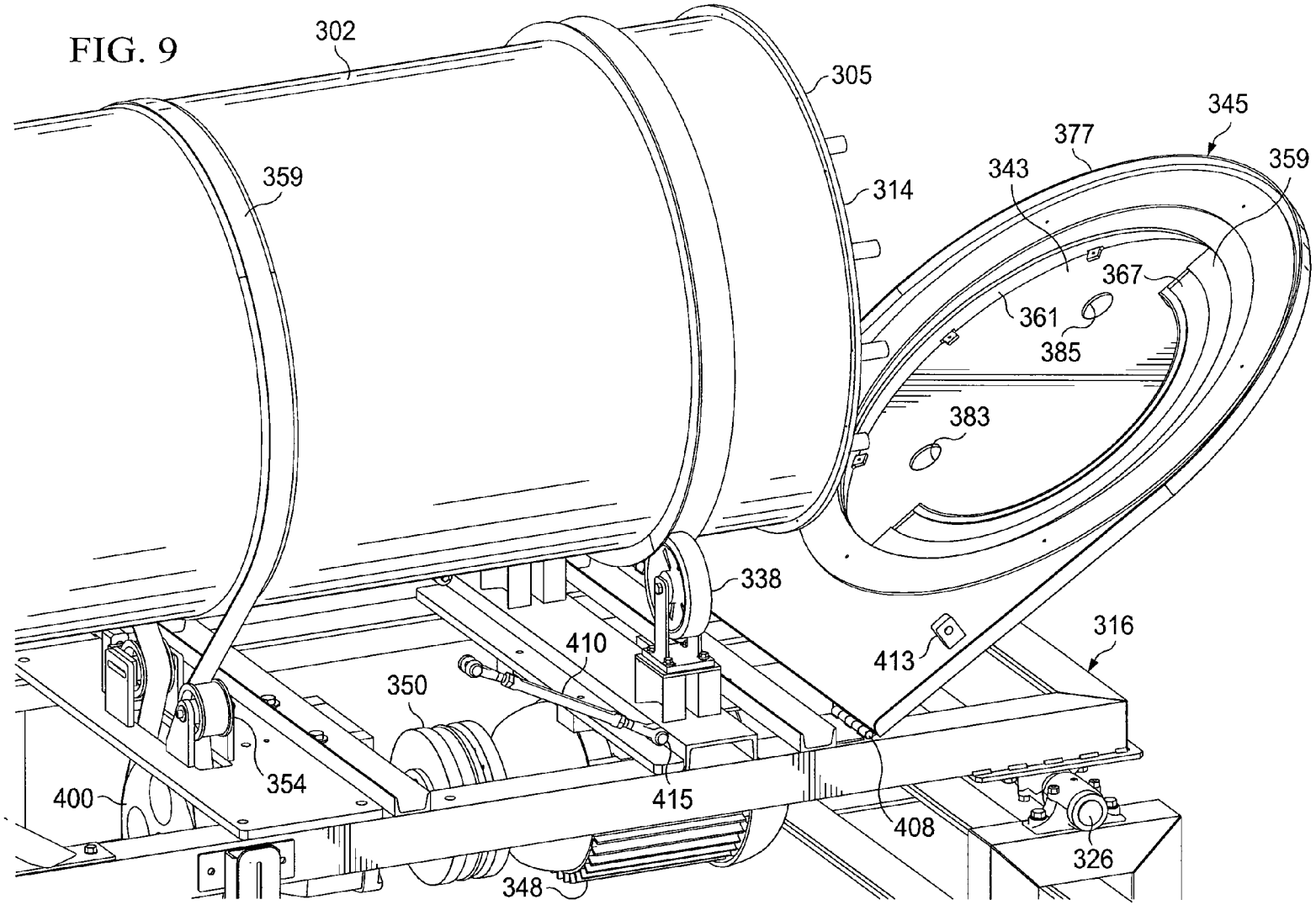
FIG. 9 is a schematic, perspective view of a portion of the system of FIG. 7.

A second rotation device 362 is operably coupled to the plurality of longitudinal brushes 366 for rotating the longitudinal brushes 366 in a second direction. One or more control devices 396 are associated with the second rotation device 362. The second rotation device 362 may be a single unit operably linked (e.g., belts and pulleys, gears, or other linkage) to each of the longitudinal brushes 366 or each longitudinal brush may have its own rotation device, e.g., motor. One or more second rotation devices 362 may be mounted to either end plate 344, 345, or as shown in FIG. 8 to a super structure 363. The super structure 363 does not require removal in order move the first end plate 344 from the closed to the open position.

In order to clean any debris, linters, or other material that may lodge in the filaments of the brush unit 422, a longitudinal rod 438 may be disposed within the cavity 304 with an interference with a plurality of filaments of the brush unit 422. The interference may be 10-90% of the filament length. The longitudinal rod 438 is shown after the last downstream longitudinal brush 366 in the direction of rotation of the rotatable drum 302. Alternatively, a doffer brush (see 170 in FIG. 2) may be used.

In operation according to one embodiment of the system 300, seeds, e.g., ginned cottonseeds or other seeds are introduced into the cavity 304. The angle between the frames 318, 320 may be adjusted to modify performance of the system 300. The first rotation device 348 and second rotation device 362 are activated. The rotatable drum 302 is rotated between 100 and 300 RPM and the centrifugal force urges the seeds against the brush insert 306. In addition, the plurality of longitudinal brushes 366 turn in a direction opposite the rotation of the interior of the rotatable drum 302 and are positioned to further urge the seeds against the brush insert 306. The seeds migrate along the rotatable drum 302 as they are processed and are eventually removed at the seed off take, or seed removal conduit 414. Material, or a portion of each of the exterior of the seeds, e.g., linters, is removed from the seeds and then removed from the cavity 304 through the seed-material off take 418. The system 300 may operate as a batch process or may run continuously using the feed mechanism 371.

Once a run is complete, it may be desirable to completely clean the cavity 304 and change the brush insert 306 before running a next batch of seeds. This allows for seed processing of multiple runs with no contamination. To clean and change the brush insert 306, either the first end plate 344 or second end plate 345 (or both) is moved from the closed position to the open position. For example, the second rotation device 362 may be uncoupled from the plurality of longitudinal brushes 366, the fasteners 406 released, and the first end plate 344 rotated about pivot 404 to the open position. Then, the portion of the spring frame 420 of the brush insert 306 is caused to come off the raised, longitudinal ridge member 303 and this frees the brush insert 306 to be removed. The interior surface 308 may be cleaned and a new brush insert 306 installed. In doing so, the longitudinal seam edges 428, 430 are placed against or abutting the raised, longitudinal ridge member 303 and released. The tension of the spring frame 420 against the raised, longitudinal ridge member 303 holds the brush insert 306 in place for use. Such a change and cleaning may allow seed processing of different batches with no contamination.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment. For example, features shown in the embodiments of FIGS. 1-6 may be used with the embodiments of FIGS. 7-11 and vice-versa.

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate.

Where appropriate, aspects of any of the examples described above may be combined with aspects of any of the other examples described to form further examples having comparable or different properties and addressing the same or different problems.

It will be understood that the above description of preferred embodiments is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

We claim:

1. A system for removing linters from ginned cottonseeds, the system comprising:

a rotatable drum having an exterior surface and an interior surface, wherein the interior surface defines, at least in part, a cavity, wherein the cavity has a first longitudinal-end opening and a second longitudinal-end opening;

a raised, longitudinal ridge member that extends longitudinally on the interior surface of the rotatable drum;

a frame for rotatably supporting the rotatable drum;

a brush insert comprising:

a spring frame having a first surface and a second surface, wherein the spring frame has a first longitudinal seam edge and a second longitudinal seam edge and a first longitudinal edge and a second longitudinal edge, wherein the spring frame is configured to assume a tubular position having an exterior diameter less than an interior diameter of the rotatable drum, and wherein, once inserted into the cavity of the rotatable drum, the spring frame is urged against the interior surface of the rotatable drum, a brush unit having a proximal base end and a filament end having a plurality of flexible filaments, wherein the proximal base end is coupled to the first surface of the spring frame;

wherein the brush insert is disposed in the cavity with the second surface of the spring frame proximate the interior surface of the rotatable drum, the first longitudinal seam edge and the second longitudinal seam edge are configured to abut a portion of the raised, longitudinal ridge member on the interior surface of the rotatable drum;

a first rotation device operably coupled to the rotatable drum for rotating the rotatable drum relative to the frame in a first direction such that a centrifugal force urges the cottonseeds in the rotatable drum against the brush insert;

a first end plate substantially covering the first longitudinal-end opening of the cavity;

a second end plate substantially covering the second longitudinal-end opening, a cottonseed-introduction aperture fluidly coupled to the cavity for introducing cottonseeds having linters into the cavity;

a plurality of longitudinal brushes, each longitudinal brush of the plurality of longitudinal brushes is rotatably coupled to the first end plate and the second end plate and each longitudinal brush has brush elements that are configured to bias the cottonseeds having linters against the brush insert on the interior surface of the rotatable drum;

a second rotation device operably coupled to at least one of the plurality of longitudinal brushes, for rotating the at least one of the longitudinal brushes in a second direction;

a linter-removal aperture fluidly coupled to the cavity and to a reduced-pressure source for removing linters from the cavity; and a seed-removal conduit fluidly coupled to the cavity for removing the cottonseeds after delinting.

2. The system of claim 1, wherein the first end plate is pivotably coupled to the frame by one or more hinges and at least one fastener.

3. The system of claim 2, wherein the at least one fastener comprises a turnbuckle releasably coupled to the frame and the first end plate.

4. The system of claim 1, wherein the first end plate is pivotably coupled to the frame by at least one hinge and at least one first fastener and the second end plate is pivotably coupled to the frame by at least one hinge and at least one second fastener.

5. The system of claim 4, wherein the at least one first fastener comprises at least one turnbuckle and wherein the at least one second fastener comprises at least one turnbuckle.

6. The system of claim 1, wherein the brush insert comprises a plurality of brush insert segments.

7. The system of claim 6, wherein a first brush insert segment of the plurality of brush segments has a plurality of filaments with a first rigidity and a second brush segment of the plurality of brush segments has a plurality of filaments with a second rigidity, and wherein the filaments of the first brush segment are more rigid than the filaments of the second brush segment.

8. The system of claim 1, wherein the brush insert comprises a polymer brush having brush filaments with lengths having an average greater than 0.25 inches and less than two inches.

9. The system of claim 8, wherein the brush filaments comprise abrasive grit coupled on an exterior of the brush filament.

10. The system of claim 1, wherein the brush unit is coupled to the first surface of the spring frame using an adhesive.

11. The system of claim 1, wherein the brush unit is coupled to the first surface of the spring frame using a hook-and-loop fastener.

12. The system of claim 1, wherein the first end plate is coupled to the frame by at least one hinge and at least one fastener and wherein the frame further comprises a super structure extending proximate to the first end to which the second rotation device is coupled.

13. The system of claim 1, wherein the first rotation device is operable to rotate the rotatable drum at a rotational speed greater than or equal to 100 revolutions per minute (RPM).

14. The system of claim 1, wherein the first end plate comprises a see-through material.

15. The system of claim 1, wherein the first end plate and second end plate comprise a see-through material.

16. The system of claim 1, wherein the spring frame of the brush insert further comprises a lip formed on the first longitudinal seam edge that abuts and extends over the raised, longitudinal ridge member.

17. The system of claim 1, further comprising a longitudinal rod disposed within the cavity have an interference with a plurality of filaments of the brush unit that is less than 10% of the filament length for removing matter lodged within the plurality of filaments of the brush unit.

18. A system for removing at least a portion of an exterior of a plurality of seeds, the system comprising:

a rotatable drum having an exterior surface and an interior surface, wherein the interior surface defines, at least in part, a cavity, wherein the cavity has a first longitudinal-end opening and a second longitudinal-end opening;

a raised, longitudinal ridge member that extends longitudinally on the interior surface of the rotatable drum;

a frame for rotatably supporting the rotatable drum;

a brush insert comprising:

a spring frame having a first surface and a second surface, wherein the spring frame has a first longitudinal seam edge and a second longitudinal seam edge and a first longitudinal edge and a second longitudinal edge, wherein the spring frame is operable to assume a tubular position having an exterior diameter less than an interior diameter of the rotatable drum, and wherein the spring frame is urged against the interior surface of the rotatable drum when inserted, a brush unit having a proximal base end and a filament end having a plurality of flexible filaments, wherein the proximal base end is coupled to the first surface of the spring frame;

wherein the brush insert is disposed in the cavity with the second surface of the spring frame proximate the interior surface of the rotatable drum, the first longitudinal seam edge and the second longitudinal seam edge are configured to abut a portion of the raised, longitudinal ridge member on the interior surface of the rotatable drum;

a first rotation device operably coupled to the rotatable drum for rotating the rotatable drum relative to the frame in a first direction such that a centrifugal force urges the seeds in the rotatable drum against the brush insert;

a first end plate substantially covering the first longitudinal-end opening of the cavity;

a second end plate substantially covering the second longitudinal-end opening, a seed-introduction aperture fluidly coupled to the cavity for introducing seeds having an exterior portion to be removed into the cavity;

a plurality of longitudinal brushes, each longitudinal brush of the plurality of longitudinal brushes is rotatably coupled proximate to the first end plate and the second end plate and each longitudinal brush has brush elements that are configured to bias the seeds against the brush insert on the interior surface of the rotatable drum;

a second rotation device operably coupled to at least one of the plurality of longitudinal brushes, for rotating the at least one of the longitudinal brushes in a second direction;

a removal aperture fluidly coupled to the cavity and to a reduced-pressure source for removing any matter removed from the plurality of seeds from the cavity; and a seed-removal conduit fluidly coupled to the cavity for removing the seeds after at least a portion of the exterior of the seeds has been removed.

19. A method for removing linters from at least two sets of ginned cottonseeds without contamination, the method comprising:

inserting the first set of ginned cottonseeds into a rotatable drum having an interior surface with a first brush insert against the interior surface, the brush insert having brush filaments;

positioning a first end plate and a second end plate proximate to the rotatable drum to substantially seal a cavity in which the first set of ginned cottonseeds is disposed;

rotating the rotatable drum in a first direction to cause the first set of ginned cottonseeds to press against the brush filaments of the first brush insert;

rotating a plurality of longitudinal brushes that extend longitudinally within the rotatable drum and that are configured to further press the first set of cottonseeds against the brush filaments of the first brush insert, wherein the plurality of longitudinal brushes are rotated in a second direction;

whereby the action of the first set of ginned cottonseeds pressing against the brush filaments of the first brush insert over time removes the linters from the first set ginned cottonseeds to produce a first set of cleaned seeds and a first set of linters;

removing the first set of linters from the cavity;

removing the first set of cleaned seeds from the cavity;

removing at least a portion of the first end plate or the second end plate from the rotatable drum to provide access to the cavity;

removing the first brush insert;

installing a second brush insert;

cleaning or replacing the plurality of longitudinal brushes;

repositioning the first end plate or second end plate proximate to the rotatable drum;

inserting a second set of ginned cottonseeds into the rotatable drum;

rotating the rotatable drum to cause the second set of ginned cottonseeds to press against the brush filaments of the second brush insert;

rotating the plurality of longitudinal brushes to cause the second set of ginned cottonseeds to further press against the second brush insert;

whereby the action of the second set of ginned cottonseeds pressing against the brush filaments of the second brush insert over time removes the linters from the second set of ginned cottonseeds to produce a second set of cleaned seeds and a second set of linters;

removing the second set of linters from the cavity; and removing the second set of cleaned seeds from the cavity.

20. The method of claim 19, wherein an interior of the rotatable drum includes a raised, longitudinal ridge member that extends longitudinally on an interior surface of the rotatable drum and wherein a portion of the brush insert abuts the raised, longitudinal ridge member and wherein the steps of removing the first brush insert and installing a second brush insert comprise:

moving a portion of the first brush insert that abuts the raised, longitudinal ridge member so that the portion of the brush insert no longer abuts the raised, longitudinal ridge member, whereby the first brush insert is removed from the cavity;

inserting the second brush insert into the rotatable drum; and moving a portion of the second brush insert so that the second brush insert abuts the raised, longitudinal ridge member on two sides and thereby the second brush insert is maintained in position.

* * * * *